United States Patent [19]

Lan

[11] Patent Number: 4,760,987

[45] Date of Patent: Aug. 2, 1988

[54] CUP-HOLDER STABILIZER

[76] Inventor: Yung-Huei Lan, 3F, No. 32, Lane 61, Han-Chuo S. Rd., Sec 2, Taipei, Taiwan

[21] Appl. No.: 818,368

[22] Filed: Jan. 13, 1986

[51] Int. Cl.[4] ..... A45D 42/14

[52] U.S. Cl. ..... 248/346.1; 248/363

[58] Field of Search ..... 248/363, 346.1, 205.5, 248/205.6, 205.7, 309.3, 362, 154

[56] References Cited

U.S. PATENT DOCUMENTS

| | | | |
|---|---|---|---|
| 2,009,721 | 7/1935 | Williams | 248/362 X |
| 2,565,793 | 8/1951 | Weismantel | 248/363 |
| 2,601,279 | 6/1952 | Hacus | 248/363 |
| 2,812,614 | 11/1957 | Ladyman | 248/362 X |
| 2,871,615 | 2/1959 | Borah | 248/346.1 |
| 2,932,119 | 4/1960 | Borah | 248/346.1 |
| 2,963,256 | 12/1960 | Borah | 248/346.1 |
| 2,968,888 | 1/1961 | Borah | 248/346.1 |
| 3,268,198 | 8/1966 | Swett | 248/346.1 |
| 3,514,065 | 5/1970 | Litt et al. | 248/363 |
| 3,633,863 | 1/1972 | Abbey | 248/346.1 |
| 3,679,161 | 7/1972 | Husting | 248/154 |
| 4,001,444 | 1/1977 | Clarke | 248/154 X |
| 4,291,866 | 9/1981 | Peterson | 248/363 |

FOREIGN PATENT DOCUMENTS

| | | | |
|---|---|---|---|
| 1008093 | 10/1965 | United Kingdom | 248/346.1 |

*Primary Examiner*—Randolph A. Reese
*Assistant Examiner*—Peter M. Cuomo

[57] ABSTRACT

A cup-holder stabilizer includes an upper holder portion adapted for the insertion of a cup or glass and formed with plural inner cylinders under the holder portion each formed with a valve inside the inner cylinder, a supporting base correspondingly formed with plural outer cylinders each reciprocatively engaged with each inner cylinder, and a plurality of suction cups each formed a central hole on the bottom portion of the suction cup, so that upon the gravitational retraction of the inner cylinders into the outer cylinders, the valves will seal all suction cup bottom holes so as to form vacuum for stably gripping the cup holder on a supporting surface and upon the raising of the cup with the upper holder, the valve will open the suction cup bottom hole to release vacuum for their easy removal.

4 Claims, 2 Drawing Sheets

CUP-HOLDER STABILIZER

BACKGROUND OF THE INVENTION

Those daily articles such as a glass, a bottle, a cup, a jar or the like are easily turned over if being impacted by an external force. In order to stably put a cup on a table, a coaster with large base extension is provided to hold the cup or a fixed frame is set up to hold the cup, which however may occupy a bigger space to thereby cause inconvenience for the user.

The present inventor has found the defects of a conventional coaster or a fixed frame for holding a cup, and invented the present cup-holder stabilizer.

SUMMARY OF THE INVENTION

The object of the present invention is to provide a cup-holder stabilizer including an upper holder portion adapted to hold a cup or a glass and formed with several inner cylinders, a supporting base as positioned under the upper holder portion and having several outer cylinders for reciprocally engaging the inner cylinders of the upper holder portion and several suction cups each mounted under each outer cylinder of the base, whereby upon the gravitational depression of the upper holder portion as inserted by a cup or a glass, the inner cylinders with valves will be respectively retracted into the outer cylinders to seal several holes each formed on a concave bottom portion of each suction cup so as to form a vacuum for the stable griping of the cup holder on a supporting surface by the vacuum suction; and whereby if raising the upper holder portion and the cup, the vacuum in each suction cup will be released by opening the hole formed on each suction cup bottom for easy portable purpose of the cup and its holder.

DETAILED DESCRIPTION

Figure 1:
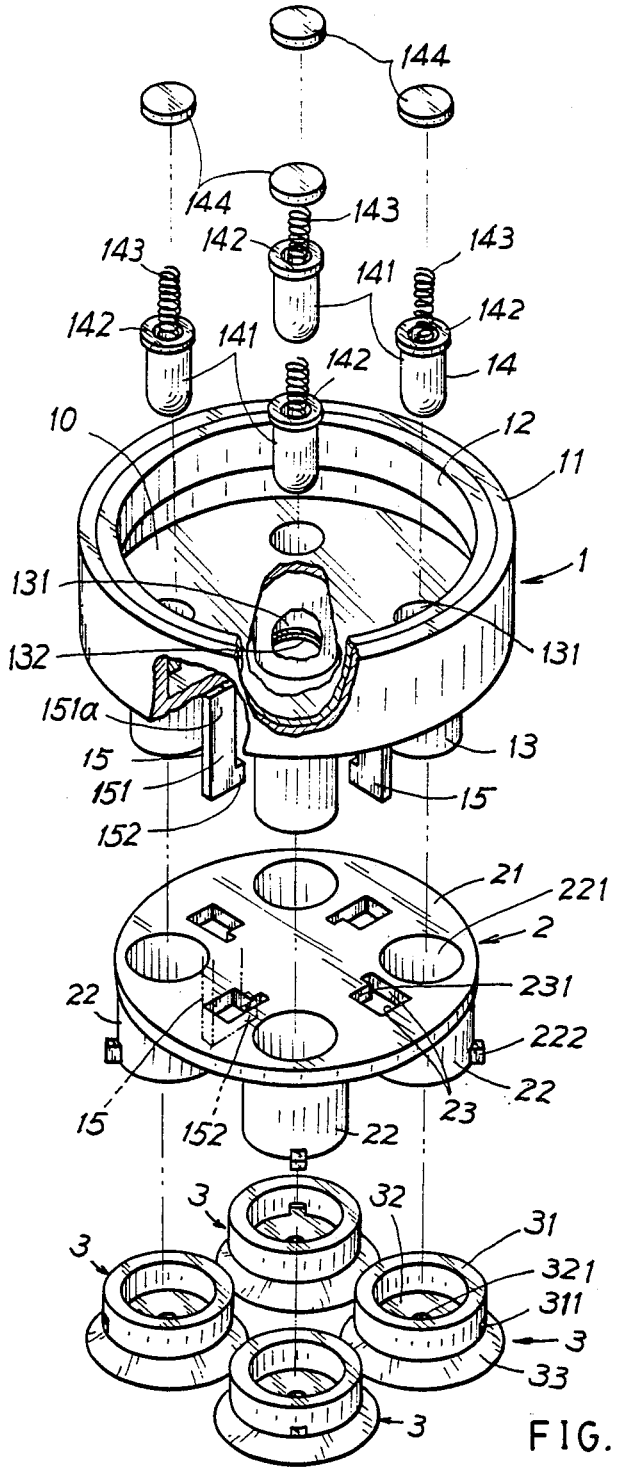
FIG. 1 is a perspective drawing of the present invention as disassembled.
Figure 2:
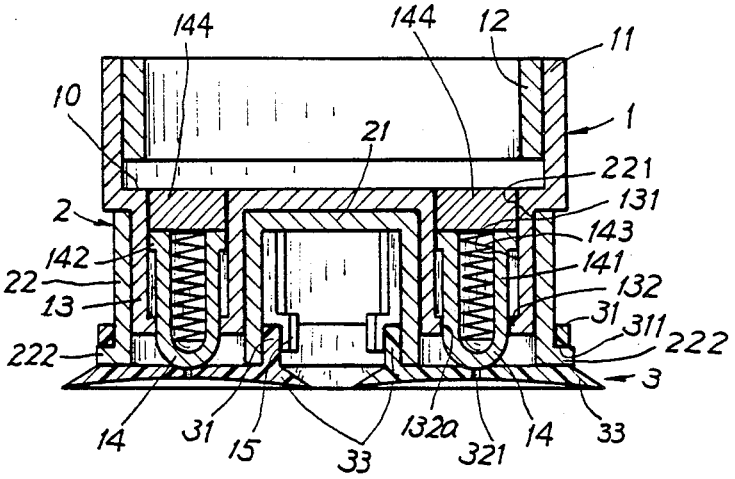
FIG. 2 is a sectional drawing of the present invention when assembled.

As shown in FIGS. 1 and 2, the present invention comprises: an upper holder portion 1, a supporting base 2 formed under the upper holder portion 1, and four suction cups 3 respectively mounted under the supporting base 2.

The upper holder portion 1 includes: a cylindrical socket 11 having a bottom plate 10 formed on its bottom portion and an inner lining 12 fixed inside the cylindrical wall of the socket 11 adapted for holding a cup or a glass fixed therein, four inner cylinders 13 formed under the bottom plate 10, four valves 14 each formed within each inner cylinder 13, and four L-shaped locking arms 15 each formed under the bottom plate 10 and each positioned between two neighboring inner cylinders 13.

Each inner cylinder 13 is formed with a through hole 131 and a lower annular extension 132 formed on the lower end of the through hole 131. The lower annular extension 132 defines a central hole **132*a*. Each valve 14 includes: a nipple portion 141 preferably made of rubber or elastomer materials having an upper flange 142 reciprocally moving in the through hole 131 and being operatively obstructed or limited by the lower annular extension 132 when moving the upper holder portion 1 upwards; a restoring spring 143 inserted within the nipple portion 141 normally tensioning or acting the nipple portion downwards as retained by a retainer cap; and the retainer cap 144 fixed on an upper portion of the cylinder 13 to be coplanar with the upper surface of the bottom plate 10 either by adhesive or by other mechanical ways, such as a screw connection. Such a nipple portion 141 normally protrudes downwards through the central hole 132*a* to seal a hole 321 formed on each suction cup 3. Each L-shaped locking arm 15 having a length longer than that of each inner cylinder 13 includes a vertical section 151 having its upper portion 151*a* formed under the bottom plate 10, and a horizontal section 152 formed on the lower portion of the section 151 and radially extending inwards towards the center line of the cylindrical socket 11**.

The supporting base 2 adapted to support the holder portion 1 has a circular plate 21, four outer cylinders 22 formed under the circular plate 21 each outer cylinder having a through hole 221 formed through the circular plate 21 to operatively reciprocally engage with the inner cylinder 13 and having a lug 222 formed on the outer lower portion of the outer cylinder 22, and four locking arm holes 23 formed through the circular plate 21 each having a tongue 231 extending outwards from a corner of hole 23 and each corresponding to each L-shaped locking arm 15 of the upper holder portion 1 adapted for the insertion of the horizontal section 152 through the hole 23 and adapted for the obstruction of the horizontal section 152 as limited by the tongue 231 when moving the upper holder poriton 1 upwards.

Each suction cup 3 includes a cylindrical wall 31 having a lug hole 311 formed thereon adapted for engaging the lug 222 of outer cylinder 22 of base 2, a concave bottom portion 32 formed on the lower portion of the cylindrical wall 31 and formed with a central hole 321 on the bottom portion 32 operatively sealed by each nipple portion 141 of valve 14, and a sealing flange 33 formed on the lowest edge of the suction cup for gripping the present invention on a supporting surface. The suction cup is preferably made of rubber or other elastomer materials so that the cylindrical wall 31 will be stably jacketed on the outer cylinder 22 by its frictional effect. Meanwhile, the lug 222 of outer cylinder 22 is engaged with the hole 311 of the suction cup 3 so that the suction cup 3 will be strongly assembled with the base 2.

When using the present invention, a cup or glass is put into the cylindrical socket 11 such that the cup and the upper holder portion 1 will gravitationally descend to allow each inner cylinder 13 downwards retracting into each outer cylinder 22 and the nipple portion 141 will be resiliently extended downwards to seal the hole 321 to allow each suction cup 3 forming a vacuum for its gripping on a supporting surface. By the way, the cup as held by this stabilizer will not be easily turned over for stable liquid storage service. If raising the holder portion 1, each inner cylinder 13 will be withdrawn from the outer cylinder 22 and the nipple portion 141 as restored downwards by the spring 143 will have its upper flange 142 limited by the lower annular extension 132 and will also be pulled upwards to open the hole 321 to release the vacuum in the sealing flange 33 for easier removal of a cup from the supporting surface.

The inner cylinder 13 should be better made for its free retraction into the outer cylinder 22 so that the upper holder portion 1 can gravitationally descend to a stable state as shown in FIG. 2, even without being loaded by a cup thereon.

Figure 3:
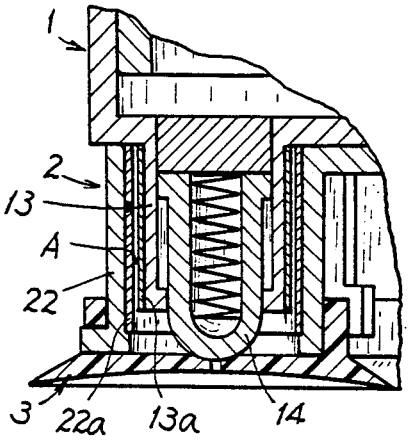
FIG. 3 is a sectional drawing of the other preferred embodiment of the present invention.

Another preferred embodiment of the present invention is shown in FIG. 3 in which an outer cylindrical jacket 13a made of materials with high friction coefficiency is coated on outer cylindrical wall of the inner cylinder 13, and an inner cylindrical lining 22a also made of materials of high friction coefficiency is coated on the inner cylindrical wall of the outer cylinder 22, both the outer jacket 13a and the inner lining 22a having an aperture A therebetween for smooth reciprocative movement of the inner cylinder 13 within the outer cylinder 22 to quickly open the central hole 321 of the cupule 3. Nevertheless, upon the lateral impacting by an external force, both jacket 13a and lining 22a will be frictionally contacted to still stabilize the present invention.

If uttermostly raising the present invention with a cup or glass, the L-shaped locking arm 15 as locked by the tongue extension 231 of the supporting base 2 will not disengage the upper holder portion 1 with lower supporting base 2.

The number of the inner cylinders 13, outer cylinders 22 and suction cups 3 are not limited in this invention. The valve 14 may also be made as a solid form to gravitationally seal the suction cup hole 321. Other modifications can be suitably modified by those skilled in the art and the modifications if without departing from the spirit of this invention as claimed still fall within the scope of this invention.

Just upon the raising of inner cylinder 13 apart from the outer cylinder 22, the valve 14 as downwardly restored by spring 143 may still seal the hole 321 until the upper flange 142 of nipple portion 141 being obstructed by the lower extension 132 of inner cylinder 13 to ensure its vacuum suction on a surface.

What is claimed is:

1. A cup-holder stabilizer comprising:

an upper holder member which has a cylindrical socket having an inner lining coating formed on an inner surface in said cylindrical socket adapted to hold a cup or glass therein, a bottom plate portion formed on a bottom portion of the upper holder member, four inner cylindrical members formed under said bottom plate portion each formed with a through hole in said inner cylindrical member, four valve members each resiliently mounted within each said inner cylindrical member and protruding downwards through the through hole of said inner cylindrical member, and four L-shaped locking arms each having a vertical section formed under said bottom plate portion and a horizontal section formed on the lower portion of the vertical section radially extending inwards towards the center line of the cylindrical socket;

a supporting base adapted to support said holder member including an upper circular plate, four outer cylinders formed under said circular plate each formed with a through hole for reciprocally engaging said inner cylindrical member therein, and four locking-arm holes formed through the circular plate to correspond the four L-shaped locking arms and each locking-arm hole having a tongue formed on a corner of said locking-arm hole adapted to obstruct said horizontal section of said L-shaped locking arm to prevent disengagement of said supporting base from said upper holder member; and four suction cup members each including a cylindrical wall mounted under each said outer cylinder, a concave bottom portion formed on the bottom of said suction cup member having a central hole operatively sealed by said valve member of said upper holder member, and a sealing flange formed on the lowest end of said suction cup member for gripping said stabilizer on a supporting surface, whereby upon a gravitational descending of the upper holder member and a cup inserted therein, each inner cylindrical member is retracted into each outer cylinder and each said valve member resiliently seals a central hole on a bottom of said suction cup member for gripping said stabilizer on a supporting surface due to vacuum suction, and upon the raising of said upper holder member, said valve member opens said central hole of said suction cup member to release its vacuum for easy removal from the supporting surface.

2. A cup-holder stabilizer according to claim 1, wherein said valve member includes a nipple portion preferably made of rubber or elastomer materials having an upper flange operatively obstructed by a lower annular extension formed on the lower end of said inner cylindrical member when raising said upper holder member, a restoring spring inserted in said nipple portion normally resiliently acting said nipple portion downwards as retained by a retainer cap, and said retainer cap fixed on the top portion of said inner cylindrical member having its upper surface coplanar to an upper surface of said bottom plate portion of said upper holder member.

3. A stabilizer according to claim 1, wherein said outer cylinder is formed with a lug on its outer lower portion adapted to engage with a lug hole formed on the cylindrical wall of said suction cup member for further securing said suction cup member to said outer cylinder of said supporting base.

4. A stabilizer according to claim 1, wherein an outer cylindrical jacket made of materials having high friction coefficiency is coated on an outer cylindrical wall of said inner cylindrical member and an inner cylindrical lining also made of materials having high friction coefficiency formed on an inner cylindrical wall of said outer cylinder, said outer cylindrical jacket and said inner cylindrical lining defining an aperture therebetween.

* * * * *

UNITED STATES PATENT AND TRADEMARK OFFICE

CERTIFICATE OF CORRECTION

PATENT NO. : 4,760,987

DATED : August 2, 1988

INVENTOR(S) : Yung-Huei Lan

It is certified that error appears in the above-identified patent and that said Letters Patent is hereby corrected as shown below: On the title page:

IN THE TITLE

Change the title to --Non-Turnover Base Device--

Col. 1, line 15 Change "Cup-holder stabilizer" to --Non-Turnover Base Device --

Col. 1, line 18, Change "cup-hold stabilizer" to --Non-Turnover Base Device--

Col. 3, line 38, claim 1, Change "cup-holder stabilizer" to --Non-Turnover Base Device--

Col. 4, line 30, claim 2, Change "cup-holder stabilizer" to --Non-Turnover Base Device--

Col. 4, line 44, claim 3, Change "stabilizer" to -- Non-Turnover Base Device--

Col. 4, line 50, claim 4, Change "stabilizer" to --Non-Turnover Base Device--

Signed and Sealed this

Third Day of July, 1990

*Attest:*

HARRY F. MANBECK, JR.

*Attesting Officer*

*Commissioner of Patents and Trademarks*